US005806474A

United States Patent [19]

Paul et al.

[11] Patent Number: 5,806,474

[45] Date of Patent: Sep. 15, 1998

[54] SELF INJECTION SYSTEM

[76] Inventors: Marius A. Paul; Ana Paul, both of 1120 E. Elm Ave., Fullerton, Calif. 92631

[21] Appl. No.: 613,839

[22] Filed: Mar. 11, 1996

Related U.S. Application Data

[63] Continuation-in-part of Ser. No. 607,945, Feb. 28, 1996.

[51] Int. Cl.[6] ..... F02M 37/04; F01L 9/02

[52] U.S. Cl. ..... 123/90.12; 123/508

[58] Field of Search ..... 123/446, 447, 123/497, 90.12, 90.13, 90.15, 507, 508; 417/380

[56] References Cited

U.S. PATENT DOCUMENTS

| | | | |
|---|---|---|---|
| 4,098,560 | 7/1978 | O'Neill | 417/380 |
| 4,476,823 | 10/1984 | Williams | 123/90.12 |
| 4,599,983 | 7/1986 | Omachi | 123/497 |
| 5,067,467 | 11/1991 | Hill | 123/497 |
| 5,125,371 | 6/1992 | Erickson | 123/90.12 |
| 5,181,494 | 1/1993 | Ausman | 123/446 |
| 5,237,968 | 8/1993 | Miller | 123/90.12 |
| 5,237,996 | 8/1993 | Lawrence | 123/90.12 |
| 5,325,824 | 7/1994 | Ballheimer | 123/446 |
| 5,445,129 | 8/1995 | Barnes | 123/446 |
| 5,462,028 | 10/1995 | Buckley | 123/508 |
| 5,463,996 | 11/1995 | Maley | 123/446 |
| 5,586,526 | 12/1996 | Linquist | 123/90.12 |

FOREIGN PATENT DOCUMENTS

| | | | |
|---|---|---|---|
| 527395 | 10/1956 | Belgium | 417/380 |
| 278423 | 10/1927 | United Kingdom | 417/380 |

*Primary Examiner*—Carl S. Miller
*Attorney, Agent, or Firm*—Bielen, Peterson & Lampe

[57] ABSTRACT

A fuel injection system for an engine having a combustion chamber, the injection system having at least one fuel injector with a hydraulically operated actuator for amplifying the pressure of fuel injected from the injector into the combustion chamber, the hydraulic actuator communicating with a hydraulic pulse pump having a slide piston displaced by the pressure of compression and combustion gases within the combustion chamber, the fuel pressure having an amplified pressure profile paralleling the developed pressure profile of gases compressed and combusted in the combustion chamber, and in an alternate embodiment the pulse pump delivers high pressure hydraulic fluid to a common rail for use by multiple injectors and including a further embodiment where the high pressure fluid in the common rail is used as the motive fluid for actuating the engine combustion chamber valves.

11 Claims, 4 Drawing Sheets

SELF INJECTION SYSTEM

BACKGROUND OF THE INVENTION

This invention is related to injection system described in U.S. Ser. No. 08/556,467 entitled Fuel Injector System with Feed-back Control filed 8 Nov. 1995, which is incorporated herein by reference and this application is a continuation-in-part of our application of the same title, Ser. No. 607,945, filed 28 Feb. 1996.

This invention relates to a fuel injection system including a fuel injector having an internal fuel injection cylinder and a hydraulic actuating cylinder with a slidable amplifier piston actuated by high pressure hydraulic fluid. In the fuel injection system of this invention, the compression and combustion pressure of the gases in the combustion chamber of the engine on which injector is mounted provide the driving pressure for pressurizing the actuating fluid. In this manner, the pressure of the injection fuel as amplified by the hydraulic actuator profiles the pressure developed in the combustion chamber. The fuel injection system of this invention can be used for a variety of internal combustion engines which are diesel or spark ignited. The system utilizes directly the effect of the thermal cycle to induce in the fuel injection process a profile that is proportional with the evolution of pressure in the compression chamber.

Conventional fuel injection systems use various pumping and actuating systems for raising the pressure of the fuel in order that it can be injected into the combustion chamber at high pressure. In these systems, the pressure is not related to the evolving pressure of the gases in the combustion chamber, but dependent on mechanical components such as an actuating cam. The profile of the fuel injection process is fundamental to customizing combustion. Controlling the combustion, speed of heat release, pressure rate, combustion noise, atomization of fuel, and cut-off at the end of the injection process must be coordinated with real-time factors such as the speed of the engine, loads, smoke and emission control, and other variables of operation. Means for variations in the combustion process are difficult with conventional, mechanical or mechanical-electrical systems.

In the invented system, the profile of the injection process has a triangular shape with an abrupt cut-off of the fuel. This maximizes the efficiency of the combustion and eliminates post injection of fuel into the combustion chamber during the expansion process. Coordinating the pressure of the fuel to be injected with the pressure of the compression and combustion gases in the combustion chamber is ideal. Adding electronic control features to initiate and terminate the injection process in accordance with operating conditions as analyzed by an electronic control module optimizes the injection and combustion process. Since the pressure regulation is automatic, the electronic control module is not required to regulate mechanical pumping components and can control the injection process using internal mapping program for idealized operation together with real-time parameters provided from positive sensors. The developed pressure of the hydraulic fluid in an alternate embodiment is used to supply a high pressure common rail for actuating multiple injectors, and in such embodiment the high pressure common rail fluid can be used to actuate the combustion chamber valves eliminating energy consuming mechanical means.

SUMMARY OF THE INVENTION

This invention relates to a fuel injection system and in particular to a fuel injection system for internal combustion engines wherein the developed pressure within the compression chamber of the internal combustion engine is utilized to generate the fuel pressure for the injection process.

The fuel injection system operates in conjunction with a hydraulic pulse pump that has a displaceable piston in a cylinder wherein the displaceable piston divides the cylinder into a pumping chamber and a gas actuating chamber. The gas actuating chamber has a passage in communication with the combustion chamber so that gases in the combustion chamber act on one side of the piston to drive the piston against the hydraulic fluid, which comprises the actuating fluid in the fuel injector. The fuel injector is of a type that includes a hydraulically actuated amplifier piston in conjunction with a fuel injector piston multiplying the effective pressure of the hydraulic fluid when transmitted to the fuel being injected. In this manner, the injection fuel pressure is idealized as a factor of the pressure of the compression and combustion gases in the compression chamber.

Control of fuel injection into the cylinders of an internal combustion engine is critical to fuel efficiency and optimized power output. Ideally, the injected fuel should be a factor of the pressure within the cylinder, in this manner, an automatic feed-back control is provided to increase the pressure of injected fuel when the engine is under high operating demands, and adjust the pressure of the injected fuel during combustion so that the peak fuel pressure coincides with the peak combustion pressure.

To facilitate optimization of the fuel injector system and enable the system to be utilized with a variety of fuels for gasoline and diesel engines, the preferred embodiment of the fuel injector system includes electronic controls for initiation of the injection process and abrupt termination of the process for abated fuel wastage by dribbling and combustion leakage. Preferred electronic control of the compression process allows the fuel injection system to be coordinated with the actual operating conditions of the engine. The use of the combustion chamber pressure, as amplified, for injection of the fuel, provides an idealized triangular shape of injection profile, which is obtained automatically. The fuel injection system has inherent self-control and the pressure of fuel injection is adjusted in the actual time of the combustion process, cycle by cycle. The capability of the individual self-control of the injection process for each cylinder, enables the potential of the system to equalize all of the factors at an absolute regime of cooperative operation. This results in a self-diagnostic and self-regulating system for uniform operation of each injector in the entire engine system.

By appropriate design of the amplification of pressure of fuel for injection, the system can be used for spark ignited engines where injection is initiated at any selected time during the intake or compression process, or by direct ignition at peak pressure.

In an alternate system, the pulse pump can be utilized to supply hydraulic fuel to a common rail for use with multiple injectors providing a high pressure common source of actuating fluid for select injectors on activation of the valve system associated with each injector. In such a system the high pressure actuating fluid of the common rail is available for actuating electronically-controlled, combustion chamber valves. In such a system, use of an electronically-controlled, hydraulic actuators for the combustion chamber valves have the advantage of eliminating all the mechanical intermediaries to drive mechanical valves including camshafts, rockers, pushers, gears bearings and other mechanical components that generate friction and add to the complexity of modern engines. These and other features of the invention will become apparent upon consideration of the Detailed Description of the Preferred Embodiments.

DETAILED DESCRIPTION OF THE PREFERRED EMBODIMENTS

Figure 1:
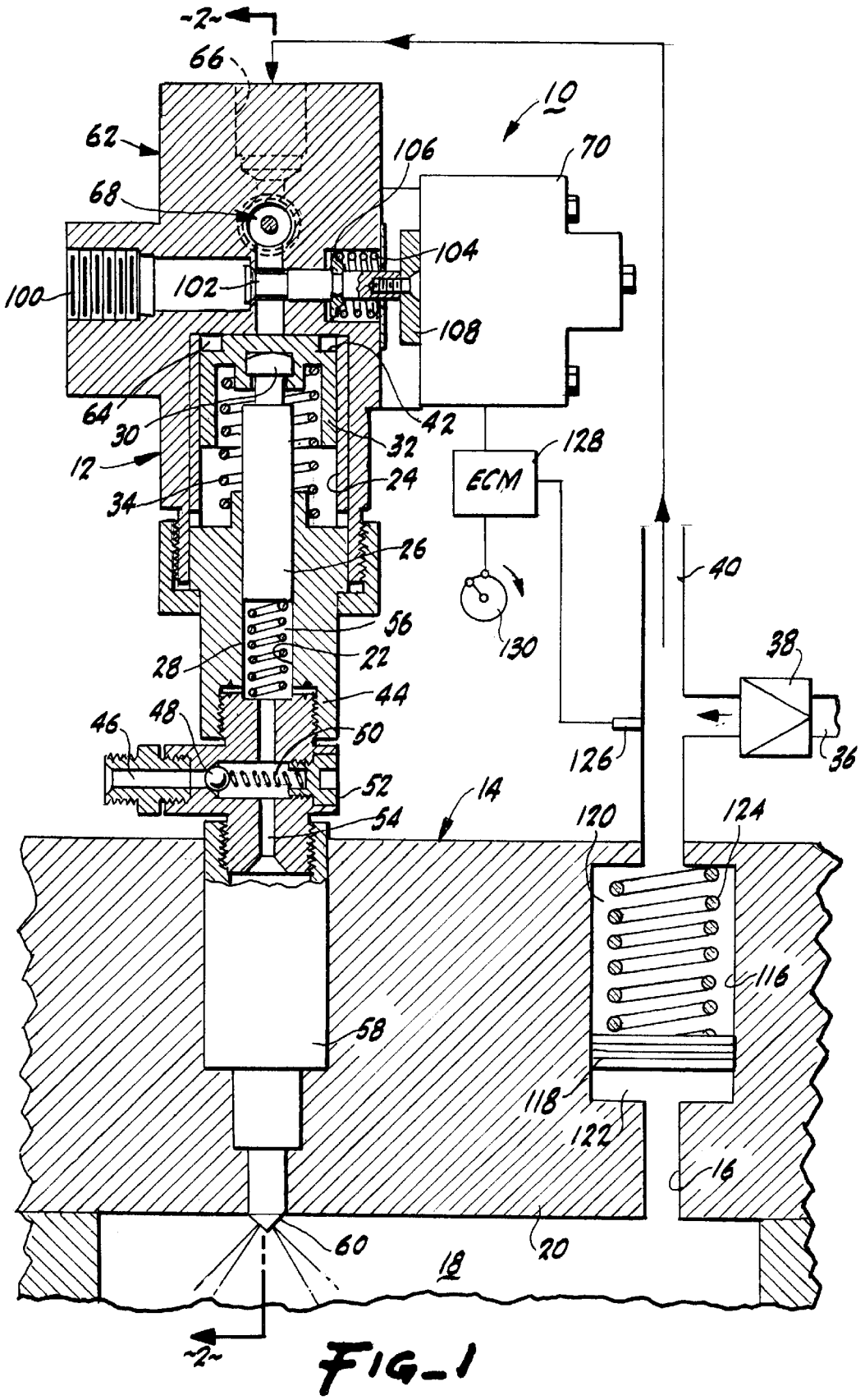
FIG. 1 is a schematic view of the fuel injection system with an injector shown partially in cross section.
Figure 2:
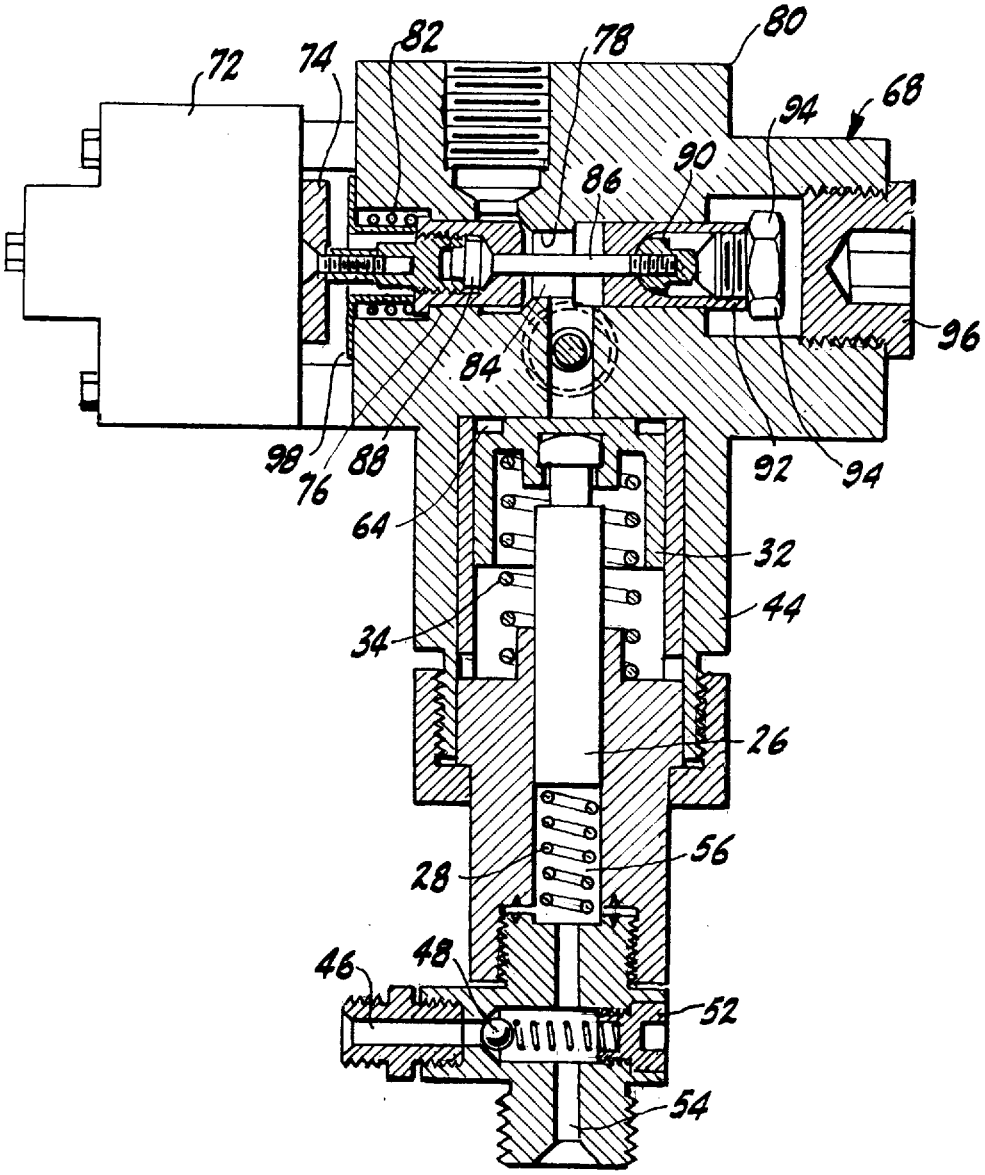
FIG. 2 is a view of the fuel injector system of FIG. 1 with the injector in partial cross section taken on the lines 2—2 in FIG. 1.

The fuel injection system of this invention is shown in a preferred embodiment in FIGS. 1 and 2. The fuel injection system, designated generally by the reference numeral 10, includes a fuel injector 12 operating in conjunction with an internal combustion engine 14, a portion of which is shown schematically in FIGS. 1 and 2. The internal combustion engine 12 is modified to provide a communicating passage 16 with the combustion chamber 18 of the internal combustion engine 14. In FIGS. 1 and 2, the communicating passage 16 and fuel injector 12 are proximately located on the engine head 20 although it is to be understood that other arrangements can be utilized in keeping in the spirit of this invention.

The fuel injector 12 has the characteristic of including a fuel injection cylinder 22 arranged in conjunction with a hydraulic actuating cylinder 24. A high pressure injector piston 26 is slidable in the injection cylinder 22 against the bias of a compression spring 28. The injector piston 26 has an end 30 coupled to an enlarged amplifier piston 32 that is slidably engaged in the actuating cylinder 24 against the bias of a compression spring 34.

Hydraulic fluid from a hydraulic fluid supply 36 protected by a check valve 38 is fed to the fuel injector 12 by a hydraulic conduit 40. It is to be understood that the fuel injector system of this invention may be utilized in gasoline or diesel engines. In the case of the diesel engine, the hydraulic supply is connected to an engine fuel supply such that the diesel fuel comprises the hydraulic fluid necessary to actuate the injector 12.

The fuel injector 12 includes a central body 44 housing the necessary hydraulic actuator components and housing a fuel supply component that includes a fuel intake port 46 protected by a check valve ball 48 that is biassed by an internal compression spring 50 seated in an access cap 52. Fuel from a fuel source (not shown) is pumped to the injector 12 in a conventional manner. When the fuel pressure exceeds the internal pressure of fuel in an internal fuel passage 54 in the central body of the fuel injector 12, fuel fills the passage 54 and a chamber 56 defined by the fuel injection cylinder 22 and the injector piston 26 as it retracts. On displacement of the piston 26 against the bias of the compression spring 28, the check valve ball 48 seats and trapped fuel is forced through the passage 54 to an injector nozzle 58 connected to the central body 44 and into the combustion chamber 18 through discharge orifices 60.

In the preferred embodiments shown, the fuel injector includes an electronically activatable valve system, designated generally by the reference numeral 62.

The valve system allows admission of pressurized hydraulic fluid from the hydraulic feed conduit to an activating chamber 64 formed by the actuating cylinder and the enlarged head 42 of the hydraulic piston 32. In FIGS. 1 and 2, the activating chamber 64 is minimal in volume representing the state prior to a pulse of hydraulic actuating fluid being delivered from the conduit to a hydraulic intake 66. The valve system 62 includes a solenoid actuated induction valve 68, shown in greater detail in FIG. 2, and a solenoid actuated relief valve 70 as shown in FIG. 1. The solenoid actuated induction valve 68 and an electronically activated solenoid 72 and a displaceable magnetic armature 74 connected to a slide valve 76 in a cross bore 78 in a valve block 80 connected to the central body 44 of the injector 12.

The slide valve 76 is biassed against a compression spring 82 so that in the deactivated state of the solenoid 72, the slide valve 76 blocks a passage 84 to the activating chamber 64. The slide valve 76 has a yoke 86 with a spherical head 88 and nut 90 to connect a slidable balancer plug 92 with a cap nut 94. The cross bore 78 has a plug nut 96 to enclose the bore and provide for access when necessary. The stroke of the armature 74 is limited by a stop 98 which contacts the housing of the solenoid 72 when the armature 74 is electronically retracted thereby displacing the slide valve 76 and opening the passage 84 to the hydraulic activating chamber 64.

In a similar manner, the solenoid actuated relief valve operates to relive the pressure in the hydraulic activating chamber 64 to allow the enlarged-head piston 32 to return to its preinjection position. Hydraulic fluid is returned to the fluid supply through the relief port 100 when poppet valve 102 is opened under push of a compression spring 104 against a spring seat 106 connected to the stem 108 and the poppet valve 102. The stem 108 is coupled to the actuator armature 110 of an electronically activated solenoid 112. In FIG. 1, the solenoid is shown activated displacing the poppet valve a short distance to its closure position preventing hydraulic fluid from passing to the port 100.

Key to the operation of the fuel injector system 10 is a hydraulic pulse pump 114 which has a pump cylinder 116 with a floating piston 118 that divides the pump cylinder into a hydraulic chamber 120 and a gas chamber 122. The free floating slide piston 118 is biassed by a compression spring 124 in the hydraulic chamber 120 to displace the slide piston 118 toward the communicating passage 16 with the combustion chamber 18. The hydraulic chamber 120 communicates directly with the hydraulic fluid conduit 40 that is filled with hydraulic fluid from the fluid supply 36 through the check valve 38. When the pressure of the fluid supply exceeds the pressure in the combustion chamber 18 shifting the slide piston 118 is shifted toward the passage 16.

In operation, as the pressure in the combustion chamber 18 builds during compression and initial ignition, the slide piston 122 is displaced toward the fluid conduit 40 transferring the pressure of the combustion chamber 18 to the entrained fluid in the conduit 40. The pressure is sensed by a pressure transducer 126 and processed by an electronic control module 128 that includes an electrical timing sensor 130 for controlled activation of the solenoids 72 and 112 of the solenoid induction valve 68 and solenoid actuated relief valve 70. When the valves are actuated under control of the control module 128, pressurized fuel in the hydraulic chamber 120 and conduit 40 pass through the hydraulic intake port by the open slide valve 76 and around the closed poppet valve 102 to the activating chamber 64. Here, the high pressure hydraulic fluid displaces the enlarged-head piston 32 and connected high pressure piston 26 to reduce the volume of the chamber 56, shifting fuel through the nozzle 58 and out the discharge orifice 60. The fuel pressure during injection is a factor of the area of the head of the piston 32 compared to the area of the end of the high pressure piston 26, and appropriate injection pressure is achieved.

For example, depending on the orifice design of the injector nozzle, it may be desirable to have the fuel pressure in the nozzle exceed the pressure in the combustion chamber by a factor of four for an optimized spray pattern. Uniquely, the profile of the fuel pressure during injection follows the profile of the gas pressure in the combustion chamber. In this manner, the pressure of injection parallels the pressure in the combustion chamber, avoiding overly high pressure at the initiation of compression or combustion. Excess fuel may otherwise be injected for incomplete burning.

In the system disclosed, after the ignition of the burst of fuel upon activation of the electronic valves, the combustion chamber on combustion builds, and the fuel supply pressure of the fuel builds at the same rate. An automatic triangular rate of fuel pressure is achieved during combustion. At the end of the injection cycle, the solenoid activated relief valve 70 is deenergized resulting in a sharp pressure drop of the amplifier piston 32 allowing the hydraulic fluid to escape through the port 100 allowing the enlarged-head piston 32 and connected fuel piston 26 to return to the preinjection position. Similarly, during the available time for recharging, through the expansion, exhaust and intake process, the floating slide piston 118 returns to its pre-pulse position allowing the chamber 120 to fill with hydraulic fluid in preparation of the next pulse. Electronic control module 128, as noted, activates the solenoids when the optimum time and pressure are reached.

Figure 3:
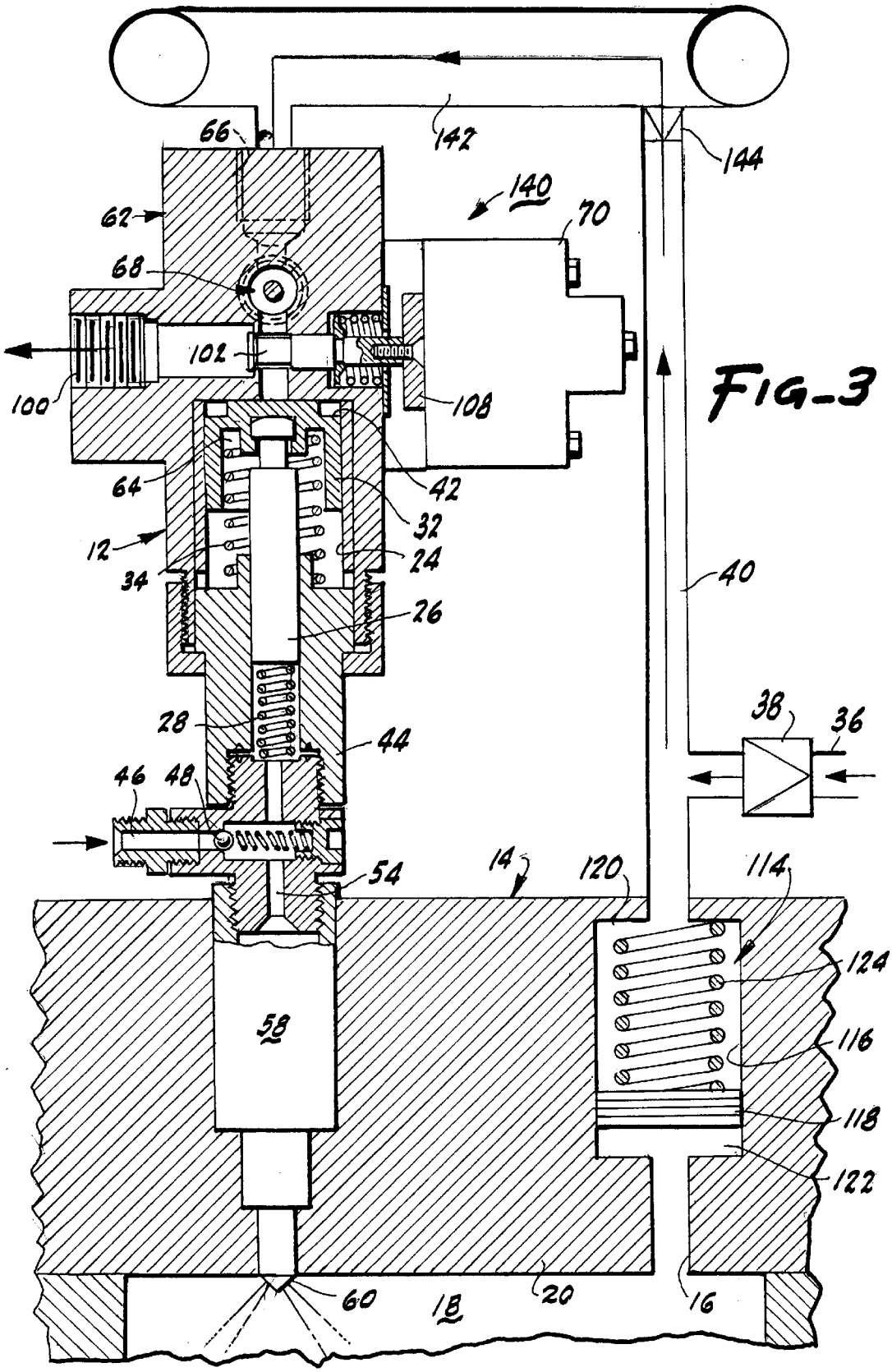
FIG. 3 is a schematic view of an alternate embodiment of the fuel injection system.

Referring to the alternate embodiment of FIG. 3. The configuration of the fuel injection system 140 is substantially the same as that described for the fuel injection system 10 of FIGS. 1 and 2. In the system 140 of FIG. 3., fuel injector 12 is connected to a common supply rail 142 which supplies high pressure hydraulic fluid to a number of similar fuel injectors in an engine 14. Common rail 142 accumulates high pressure hydraulic fluid from the fluid supply 36 protected by the check valve 38 as pressurized by the hydraulic pulse pump 114. High pressure common rail 142 has a check valve 144 allowing fluid to pass only during the forced displacement of the free floating slide piston 118. In this manner, fluid in the common rail 142 does not flow back to the conduit 40 during the expansion, exhaust and pre-compression stroke of the engine. It is preferred that each cylinder of the engine that is equipped with a fuel injector also includes a hydraulic pulse pump 114 for continuous supply of pressurized fluid to the common rail 144 during the sequenced firing process.

Figure 4:
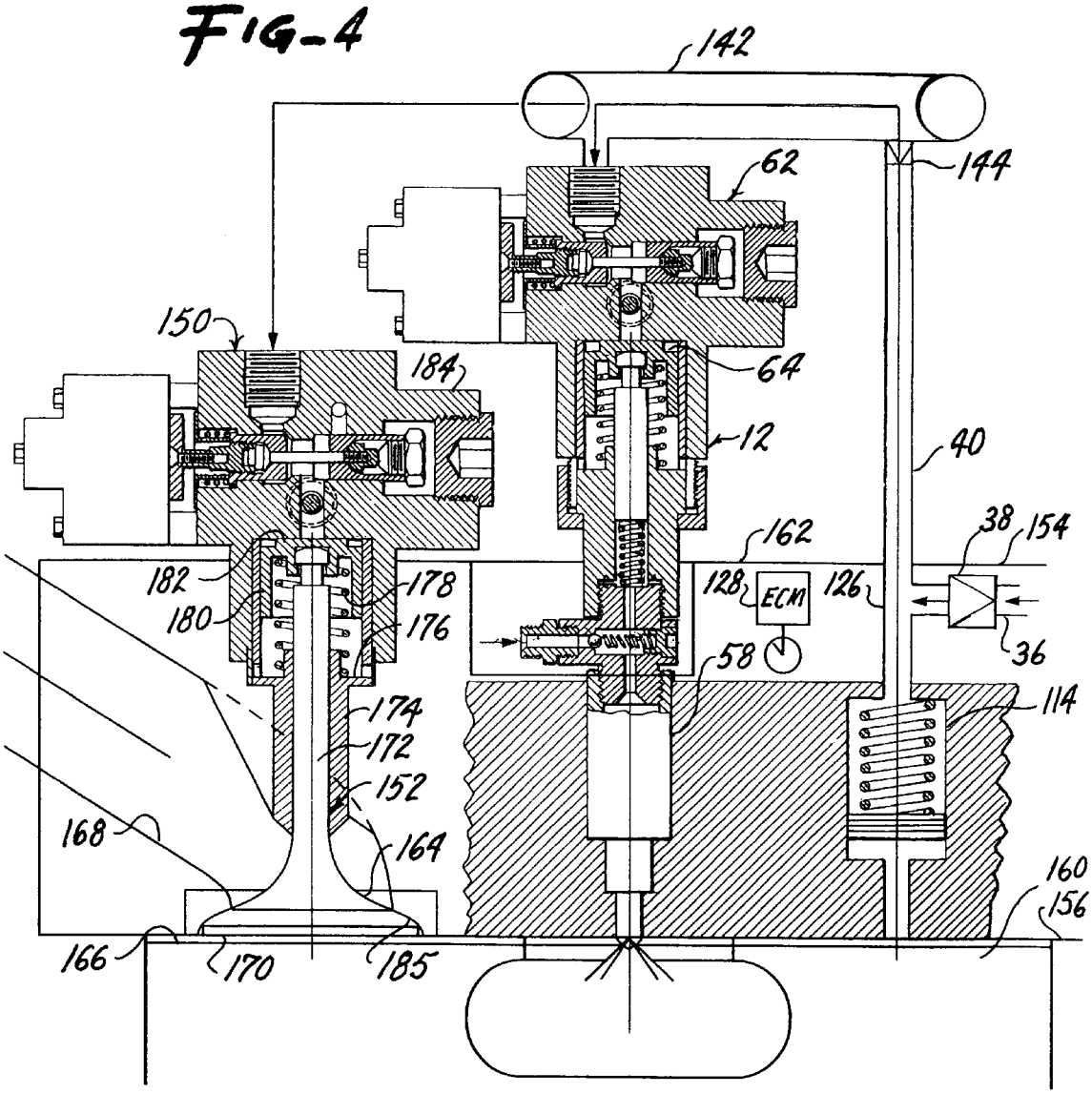
FIG. 4 is a schematic view of an alternate configuration of the embodiment of FIG. 3 showing an electronically-controlled, hydraulically actuated combustion chamber valve.

Referring to FIG. 4, the fuel injection system 140 is the same as in FIG. 3, with the common rail 142 supplying an electronically-controlled, hydraulic actuator 150 for a combustion chamber valve 152. It is to be understood that the combustion chamber valve 152 is an intake valve or exhaust valve generally of the poppet type, and that multiple intake or exhaust valves for each engine cylinder, for example in quad valve engines, are preferably independently driven by separate actuators 150.

In FIG. 4, a typical reciprocal engine 154 shown schematically, has a block 156 with a cylinder 158 in which a piston 160 is reciprocated. The fuel injector system is mounted in a head 162, together with the hydraulic pulse pump 114 and a poppet valve 164, here for example an intake valve that enables communication of a combustion chamber 166 with an intake passage 168 in conventional fashion.

The poppet valve 164 has a valve head 170 and valve stem 172 in valve guide 174. The valve guide 174 in part forms a spring seat 176 for a compression spring 178 that contacts and biases a hydraulic amplifier piston 180 slidable in a hydraulic-fluid, activating chamber 182, that is essentially the same as the chamber 64 for the fuel injection system 140. The end 184 of the valve stem 172 is connected to the enlarged-head amplifier piston 180 for displacement of the poppet valve 164 in unison with the enlarged head piston 180. The compression spring 178 returns the poppet valve to the closed position shown when the high pressure motive fluid is blocked from the actuating chamber. The piston 180 and valve 164 are displaced to open the port 185 between the combustion chamber and intake passage 168 when high pressure hydraulic fluid is admitted to the chamber 182 from the common rail 142. Timing of the actuation is controlled by the electronic control module 128 in a similar manner as the timing of the injection process. Use of the electronic control for actuation enables variation and optimization in the timing of the engine valves not possible in mechanical systems.

Delivery of hydraulic actuating fluid to the activating chamber 182 is accomplished in the same manner as the injectors using a valve system 184 that operates the same as the valve system 62 for the injector with the same elements as described with reference to FIGS. 1 and 2.

The electronic activation using a solenoid to displace control valves provides for instantaneous electronic control by the electronic control module 128 that can be optimized with a programmed map for each valve system in the same manner as injectors. Using a feedback control program of the type used in state-of-the-art electronically-controlled engines, adjustments with reference to optimization map of engine performance can be automatically made during the lifetime of the engine. This flexibility is permitted by the hydraulic actuation system which disconnects the combustion chamber valves from the mechanical linkage to the engine cycle.

In addition to the elimination of numerous mechanical parts, the system efficiently converts engine pressure to hydraulic pressure stored as potential energy in the common rail with a controlled released during engine operation.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. In an engine having a combustion chamber, a piston and at least one displaceable gas passage valve for controlled passage of gases to or from the combustion chamber, the improvement comprising an electro-hydraulic actuating system for the gas passage valve, wherein the engine has a hydraulic pulse pump having a pump cylinder with a slide piston dividing the pump cylinder into a first chamber having a passage in communication with the combustion chamber and a second chamber having a passage filled with a motive fluid, the passage being in communication with a rail means for accumulating pressurized motive fluid pumped by the pulse pump on displacement of the slide piston by the pressure of gasses in the combustion chamber, and electronically-controlled, hydraulic actuating means for displacing the displaceable gas passage valve by the motive fluid.

2. The engine of claim 1 in combination with an injector system having at least one fuel injector having an electro-hydraulic activating means for injecting fuel into the combustion chamber when electronically activated, the hydraulic activiating means being hydrualically connected to the rail means wherein the motive fluid of the rail means comprises the motive fluid for the fuel injector.

3. The engine of claim 2, wherein the electro-hydraulic actuating means for injecting fuel into the combustion chamber includes a hydraulic actuating cylinder, an electronically activatable valve means between the hydraulic actuating cylinder and the rail means for regulating flow of motive fluid from the rail means to the hydraulic actuating cylinder, the hydraulic actuating cylinder having an amplifier piston displaceable therein, the electric-hydraulic activating means including further, an injection cylinder and an injector piston slidable in the injection cylinder, the injector piston being connected to the amplifier piston and displaceable therewith.

4. The engine claim 3 wherein the electronically activatable valve means includes an electronically controlled slide valve with control means for selectively activating the slide valve and communicating the motive fluid from the rail means to the hydraulic actuating cylinder.

5. The engine of claim 4 wherein the electronically activatable valve means includes an electronically controlled relief valve with control means for selectively activating the relief valve.

6. The engine of claim 5 wherein the electronically controlled relief valve is independently operable from the slide valve.

7. The engine of claim 6 wherein the electronically controlled relief valve has an activated state blocking relief of motive fluid from the hydraulic actuating chamber.

8. The engine of claim 1 wherein the electronically-controlled hydraulic actuating means for displacing the displaceable gas passage valve includes a hydraulic actuating cylinder, an electronically activatable valve means between the hydraulic actuating cylinder and the rail means for regulating flow of motive fluid from the rail means to the hydraulic actuating cylinder, the hydraulic actuating cylinder being connected to the displaceable gas passage valve, wherein displacement of the hydraulic actuating cylinder displaces the displaceable gas passage valve.

9. The engine of claim 8 wherein the electronically activatable valve means includes an electronically actuated slide valve between the rail means and the hydraulic actuating cylinder for communicating the motive fluid in the rail means with the hydraulic actuating cylinder on electronic activation of the slide valve.

10. The engine of claim 9 wherein the electronically activatable valve means includes an additional electronically actuated slide valve blocking relief of motive fluid from the hydraulic actuating cylinder.

11. The engine of claim 10 wherein the additional electronically actuated slide valve blocks relief of motive fluid from the hydraulic actuating cylinder on electronic activation of the additional slide valve.

* * * * *